US009574439B2

(12) United States Patent
Joseph et al.

(10) Patent No.: US 9,574,439 B2
(45) Date of Patent: Feb. 21, 2017

(54) DOWNHOLE VIBRATORY COMMUNICATION SYSTEM AND METHOD

(71) Applicant: Baker Hughes Incorporated, Houston, TX (US)

(72) Inventors: Basil J. Joseph, Sugar Land, TX (US); Keven O'Connor, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 507 days.

(21) Appl. No.: 14/296,148

(22) Filed: Jun. 4, 2014

(65) Prior Publication Data

US 2015/0354350 A1 Dec. 10, 2015

(51) Int. Cl.

| | |
|---|---|
| ***E21B 47/09*** | (2012.01) |
| ***E21B 34/14*** | (2006.01) |
| ***E21B 23/02*** | (2006.01) |
| ***E21B 47/12*** | (2012.01) |
| *E21B 47/18* | (2012.01) |
| *E21B 33/12* | (2006.01) |
| *E21B 47/16* | (2006.01) |

(52) U.S. Cl.

CPC ..... *E21B 47/09* (2013.01); *E21B 23/02* (2013.01); *E21B 34/14* (2013.01); *E21B 47/12* (2013.01); *E21B 33/12* (2013.01); *E21B 47/16* (2013.01); *E21B 47/18* (2013.01)

(58) Field of Classification Search

CPC ..... E21B 47/09; E21B 34/14; E21B 23/02; E21B 47/12; E21B 47/18; E21B 33/12; E21B 47/16

See application file for complete search history.

(56) References Cited

U.S. PATENT DOCUMENTS

| | | | | | |
|---|---|---|---|---|---|
| 2,862,564 | A * | 12/1958 | Bostock | E21B 23/02 | 166/125 |
| 4,164,977 | A * | 8/1979 | Arendt | E21B 23/02 | 166/125 |
| 4,540,048 | A * | 9/1985 | Gazda | E21B 23/02 | 166/214 |
| 4,896,721 | A * | 1/1990 | Welch | E21B 23/02 | 166/214 |
| 5,166,908 | A | 11/1992 | Montgomery | | |
| 5,579,829 | A * | 12/1996 | Comeau | E21B 23/02 | 166/117.6 |
| 5,995,449 | A | 11/1999 | Green et al. | | |
| 6,021,095 | A | 2/2000 | Tubel | | |
| 6,199,632 | B1 * | 3/2001 | Shy | E21B 23/04 | 166/212 |
| 6,202,746 | B1 * | 3/2001 | Vandenberg | E21B 7/061 | 166/117.6 |
| 6,333,700 | B1 * | 12/2001 | Thomeer | E21B 23/00 | 166/254.2 |

(Continued)

FOREIGN PATENT DOCUMENTS

| | | | |
|---|---|---|---|
| EP | 0552833 | B1 | 11/1996 |
| WO | 2004018833 | A1 | 3/2004 |
| WO | 2010099465 | A2 | 9/2010 |

*Primary Examiner* — Blake Michener
(74) *Attorney, Agent, or Firm* — Shawn Hunter

(57) ABSTRACT

Systems and methods for controlling one or more downhole tools. A vibratory signal is produced by interaction between an actuation profile and a contact profile. In response to the vibratory signal, a controller actuates one or more downhole tools.

16 Claims, 8 Drawing Sheets

(56) References Cited

U.S. PATENT DOCUMENTS

| | | | | |
|---|---|---|---|---|
| 6,343,649 | B1 * | 2/2002 | Beck | E21B 31/18 166/250.01 |
| 6,364,037 | B1 | 4/2002 | Brunnert et al. | |
| 6,935,428 | B2 * | 8/2005 | McGlothen | E21B 23/01 166/117.6 |
| 7,108,073 | B2 | 9/2006 | Patel | |
| 7,237,616 | B2 | 7/2007 | Patel | |
| 7,252,152 | B2 * | 8/2007 | LoGiudice | E21B 17/1028 166/177.4 |
| 7,503,398 | B2 * | 3/2009 | LoGiudice | E21B 17/1028 166/334.4 |
| 8,297,367 | B2 * | 10/2012 | Chen | E21B 23/00 166/318 |
| 8,393,402 | B2 * | 3/2013 | Saurer | E21B 7/061 166/117.6 |
| 8,424,605 | B1 | 4/2013 | Schultz et al. | |
| 8,616,293 | B2 * | 12/2013 | Robertson | E21B 23/02 166/382 |
| 8,720,540 | B2 * | 5/2014 | Gano | E21B 23/01 166/242.6 |
| 2002/0050930 | A1 * | 5/2002 | Thomeer | E21B 23/00 340/853.3 |
| 2002/0057211 | A1 | 5/2002 | Tubel et al. | |
| 2007/0235199 | A1 * | 10/2007 | LoGiudice | E21B 17/1028 166/386 |
| 2007/0272411 | A1 * | 11/2007 | Lopez De Cardenas | E21B 34/06 166/305.1 |
| 2008/0073076 | A1 | 3/2008 | O'Malley et al. | |
| 2011/0168403 | A1 | 7/2011 | Patel | |

* cited by examiner

DOWNHOLE VIBRATORY COMMUNICATION SYSTEM AND METHOD

BACKGROUND OF THE INVENTION

1. Field of the Invention

The present invention generally relates to devices and methods for actuating or controlling one or more downhole tools or devices. In particular embodiments, the invention relates to actuation or control of a downhole device using a vibration-based trigger signal.

2. Description of the Related Art

During hydrocarbon production, a number of downhole devices are used which must be actuated or controlled from surface. In certain instances, it is impractical to run electrical, communications or even hydraulic fluid control lines to the downhole device. Another method is to transmit wireless signals such as vibrations, pressure pulses, flow pulses or electromagnetic waves along the casing or through well fluid down to the device in the wellbore. Vibrations generated at the surface can be practically transmitted along the metal casing lining the wellbore or through the annulus fluid and used as a signaling method to control downhole devices. However, fluid bubbles, discontinuities and other obstructions will dissipate surface-generated vibratory signals before they can reliably travel to deeper locations in a wellbore.

SUMMARY OF THE INVENTION

The present invention provides devices and methods for actuating or otherwise controlling one or more downhole devices by flowing a signal sub past a discrete location in a wellbore or other tubular flowbore. In described embodiments, a signal sub is provided that is used to actuate or otherwise control operation of one or more other downhole tools in a tubular flowbore. The signal sub includes an activating profile upon its outer surface. The activating profile of the signal sub is formed to be complementary to a contact profile formed within a portion of the wellbore or tubular flowbore into which the signal sub is disposed. In described embodiments, the activating profile of the signal sub is provided by an arrangement of spring-loaded dogs or pressure pads. Also in described embodiments, the complementary contact profile is provided by an arrangement of striations or grooves or shaped recesses in the interior surface of the surrounding tubular flowbore.

In exemplary embodiments, the downhole tool or tools to be activated or controlled include a programmable controller and an associated sensor. The sensor is capable of detecting a vibratory signal resulting from dynamic interaction between the actuating profile of the signal sub and the contact surface within the wellbore or other tubular flowbore. The sensor then transmits a responsive signal to the controller.

The controller is programmed to receive the signal provided by the sensor and, in response thereto, actuate or control the one or more downhole tools in a predetermined manner. In various embodiments, this operation might be the setting of a packer by a packer setting device. Alternatively, the actuating or controlling operation could include the actuation of a perforating tool, sliding of a sleeve, opening of a valve or change of operating position for a circulation tool.

The present invention provides devices and methods for actuating or otherwise controlling a downhole device using a signal sub or device that is disposed into the wellbore or tubular flowbore. The signal sub generates a vibratory pattern actuating signal upon contact between the actuating profile and the contact profile. The actuating signal is sensed by the sensor and transmitted to the controller. Upon receipt of the actuating signal, the controller will cause the downhole tool to be actuated or otherwise controlled. It can be seen then, that the invention provides for actuation or control of one or more downhole tools or devices by passing of a signal sub past a discrete location within a wellbore or other tubular flowbore which contains the proper contact profile.

BRIEF DESCRIPTION OF THE DRAWINGS

The advantages and other aspects of the invention will be readily appreciated by those of skill in the art and better understood with further reference to the accompanying drawings in which like reference characters designate like or similar elements throughout the several figures of the drawings and wherein.

DETAILED DESCRIPTION OF THE PREFERRED EMBODIMENTS

Figure 1:
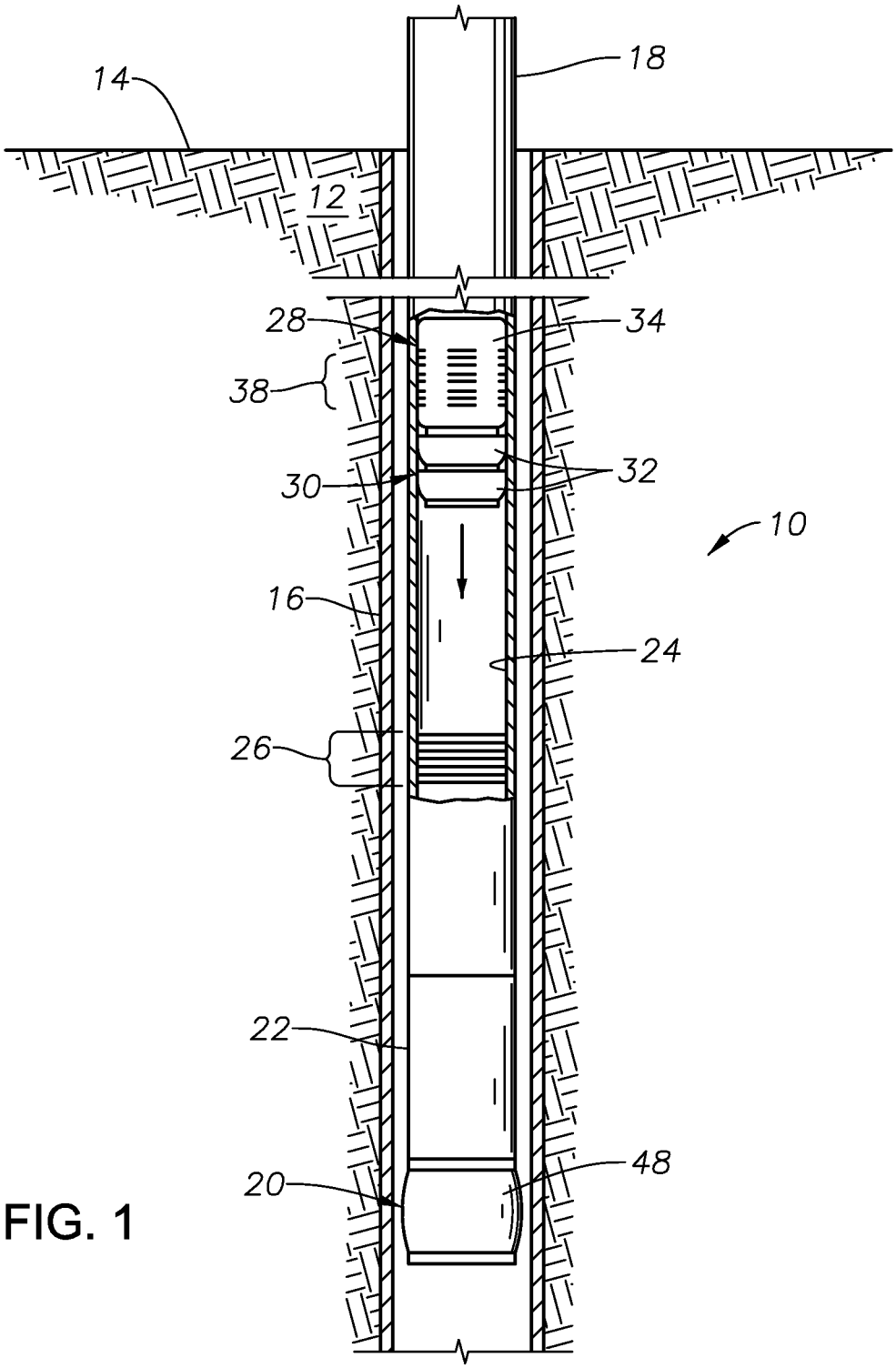
FIG. 1 is a side, cross-sectional view of an exemplary wellbore containing a downhole device to be activated by a signal sub in accordance with the present invention.
Figure 2:
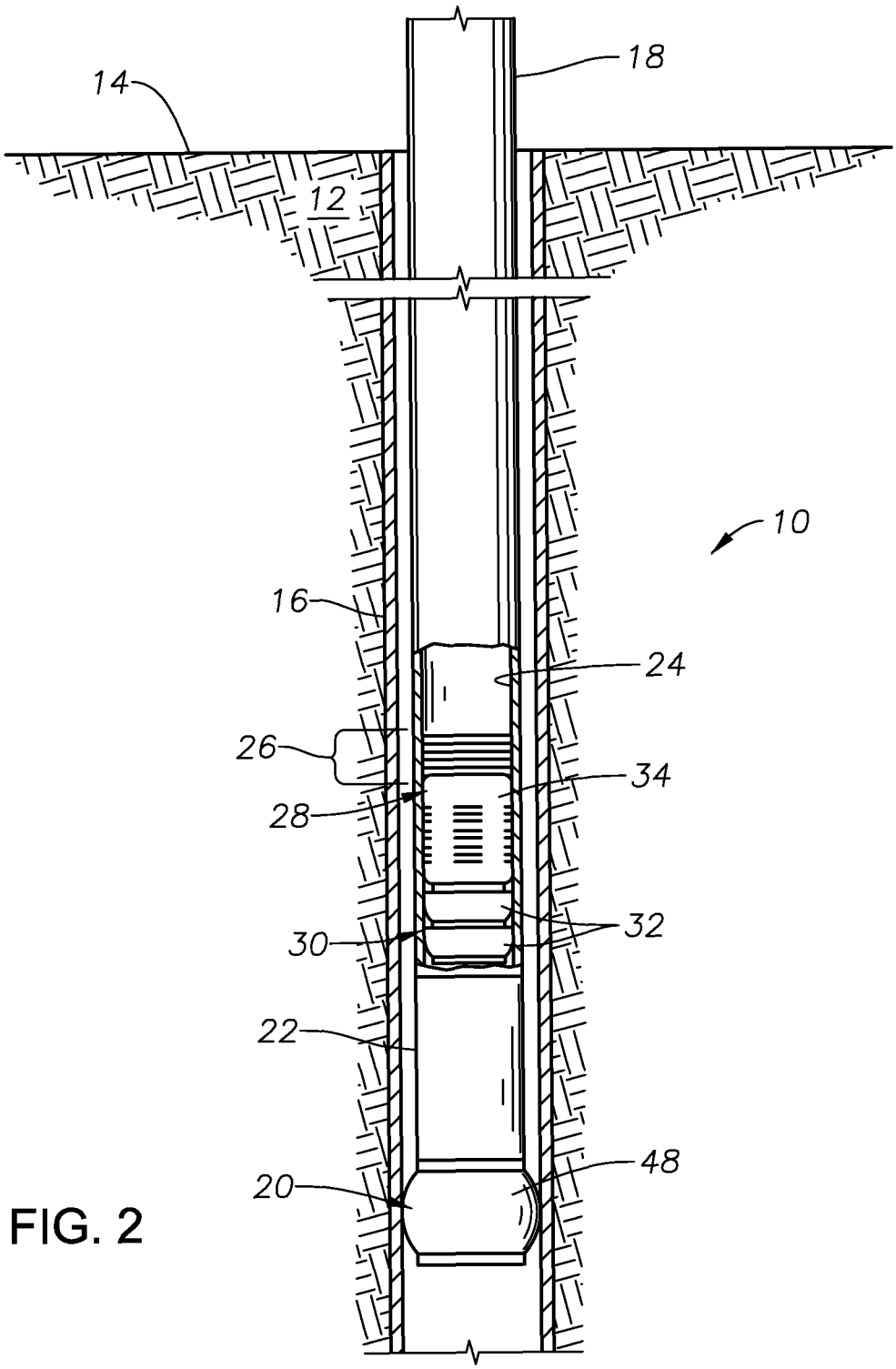
FIG. 2 is a side, cross-sectional view of the wellbore shown in FIG. 1 now with a signal sub having been disposed within the wellbore to activate the downhole device.

FIGS. 1 and 2 illustrate an exemplary wellbore 10 that has been drilled through the earth 12 from the surface 14. Metallic casing 16 lines the wellbore 10. A tubular string 18 is disposed within the casing 16 of the wellbore 10. A packer 20 and packer setting tool 22 are affixed to the lower end of the tubular string 18. As will be described, the setting tool 22 in this instance is the downhole device that is to be actuated by a signal sub in accordance with the present invention. The tubular string 18 defines a central tubular flowbore 24 along its length. A contact profile 26 is formed within the interior surface of the flowbore 24.

A signal sub 28 is secured to a pump-down plug 30 of a type known in the art. In FIG. 1, the signal sub 28 and pump-down plug 30 are shown disposed in an upper portion of the flowbore 24 of the tubular string 18. The depicted pump-down plug 30 includes radially outwardly-projecting flanges or cups 32 which are designed to capture fluid. The pump-down plug 30 can be propelled along the flowbore 24 by fluid pressure, as is known. It is noted, however, that the presence of flanges or cups 32 is not necessary to the present invention. Those skilled in the art will recognize that the plug 30 might also be a drop-bar device which can be dropped into the tubular flowbore 24 and is transported along the flowbore 24 largely by gravity.

Figure 3:
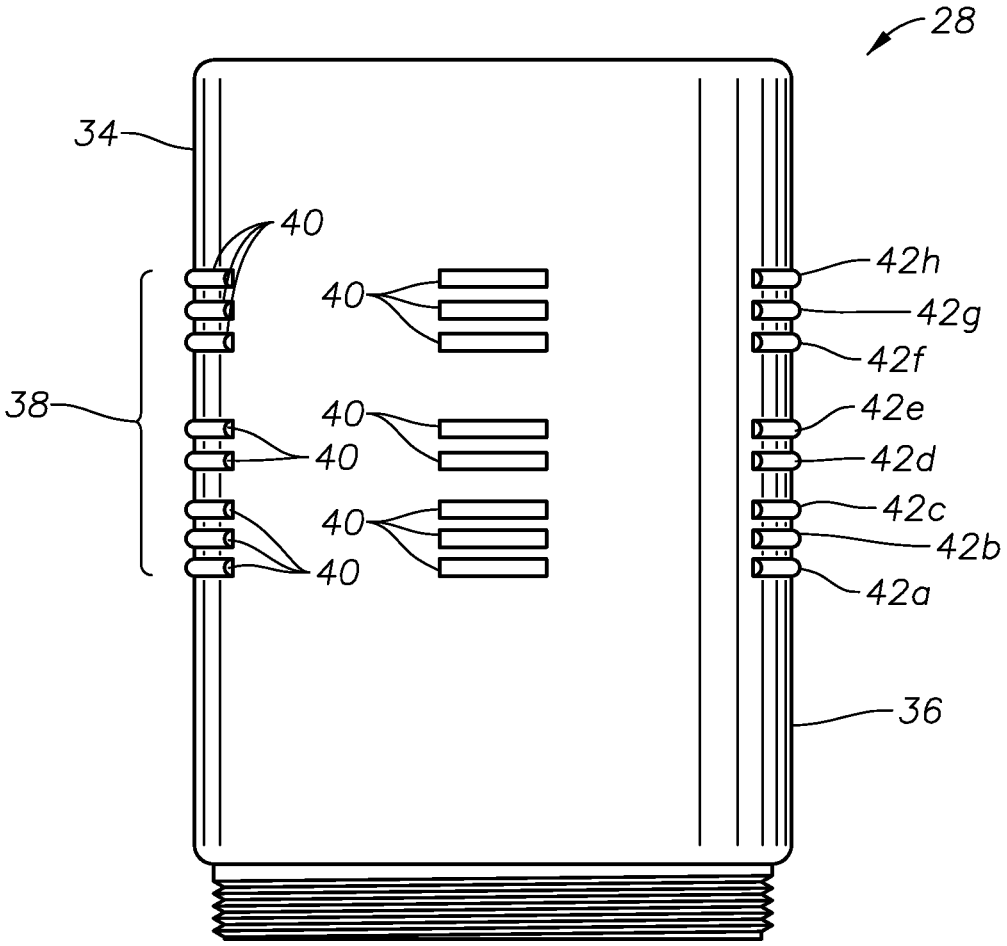
FIG. 3 is side view of an exemplary signal sub in accordance with the present invention.
Figure 7:
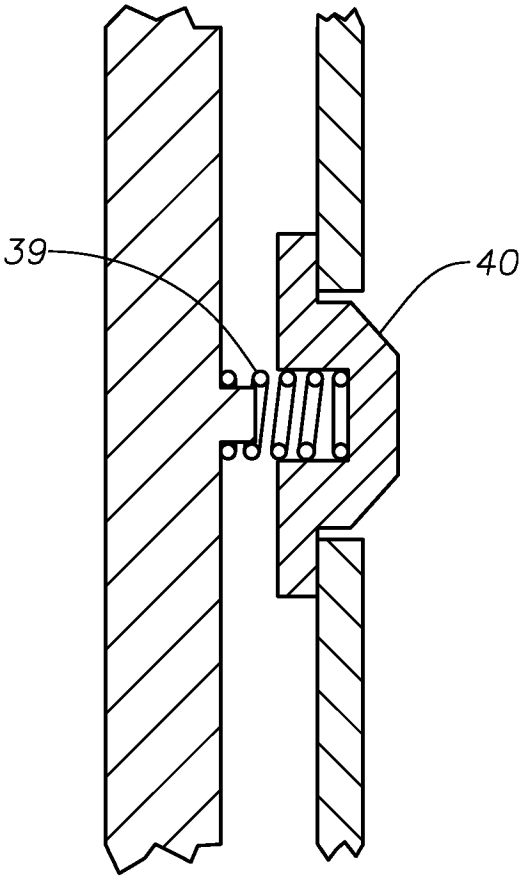
FIG. 7 is a close-up cross-sectional view of an exemplary spring-biased dog.
Figure 6:
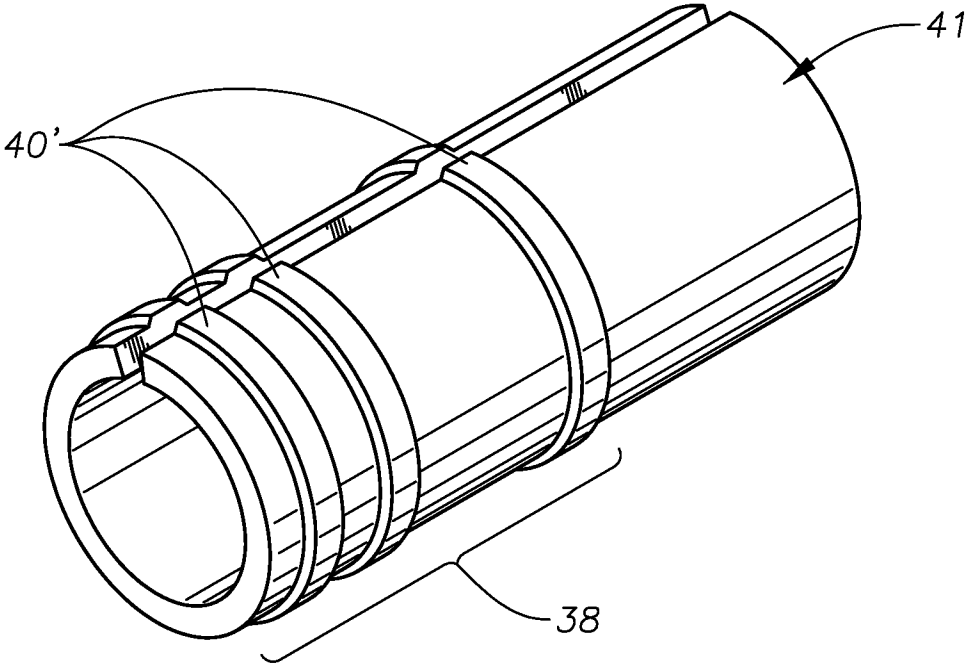
FIG. 6 is an external isometric view of an exemplary activation profile formed upon a C-ring.
Figure 8:
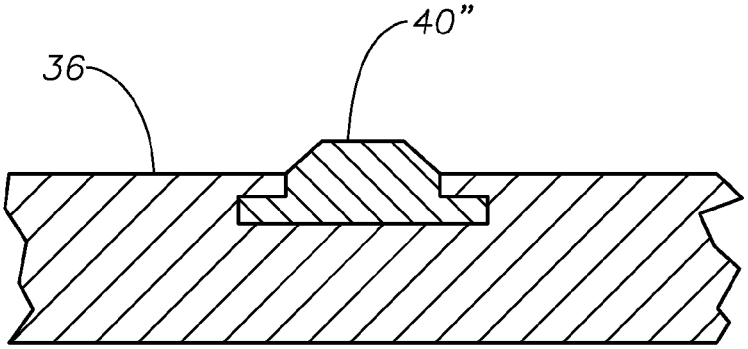
FIG. 8 is a close-up cross-sectional view of an exemplary non spring-biased dog.

The signal sub 28 is shown in greater detail in FIG. 3. The exemplary signal sub 28 includes a sub body 34 having an outer radial surface 36. An activation profile 38 is formed upon the outer radial surface 36 of the sub 28. The activation profile 38 is made up of a plurality of spring-biased dogs or pressure pads 40. The dogs 40 are biased radially outwardly from the outer radial surface 36. FIG. 7 illustrates an exemplary spring-biased dog 40. The dog 40 is biased radially outwardly by a compression spring member 39. In the embodiment shown in FIG. 3, the dogs 40 of the activation profile 38 are arranged in several rows 42 (42*a*, 42*b*, 42*c*, 42*d*, 42*e*, 42*f*, 42*g*, 42*h*). Preferably, as depicted in FIG. 3, there are a number of dogs 40 in each row 42 that are spaced about the circumference of the body 28. The dogs 40 are shown to have semi-spherical outer contact portions (i.e., for contacting the surrounding tubular string 18). However, these portions may have other different shapes or configurations, if desired. As can be seen with reference especially to FIG. 3, spacing between the rows 42 can be varied, so that a distinctive vibratory signal will be produced. In the illustrated case, the spacing between adjacent rows 42*a* and 42*b* as well as between rows 42*b* and 42*c* is closer than the spacing between rows 42*c* and 42*d*, for instance. Distinctive vibratory signals could also be produced by varying the spring stiffness under the dogs 40 such that different dogs 40 will impact the protrusions and recesses formed by grooves 44 of contact profile 26 with differing amounts of force. FIG. 6 depicts an embodiment wherein an activation profile 38 is formed upon a C-ring member 41. The C-ring member 41 might be integrated into a signal sub and will permit the dogs 40' to flex inwardly and outwardly as the C-ring contracts radially. FIG. 8 illustrates an alternative, non spring-biased dog 40" which is fixedly secured within an outer surface 36.

Figure 4:
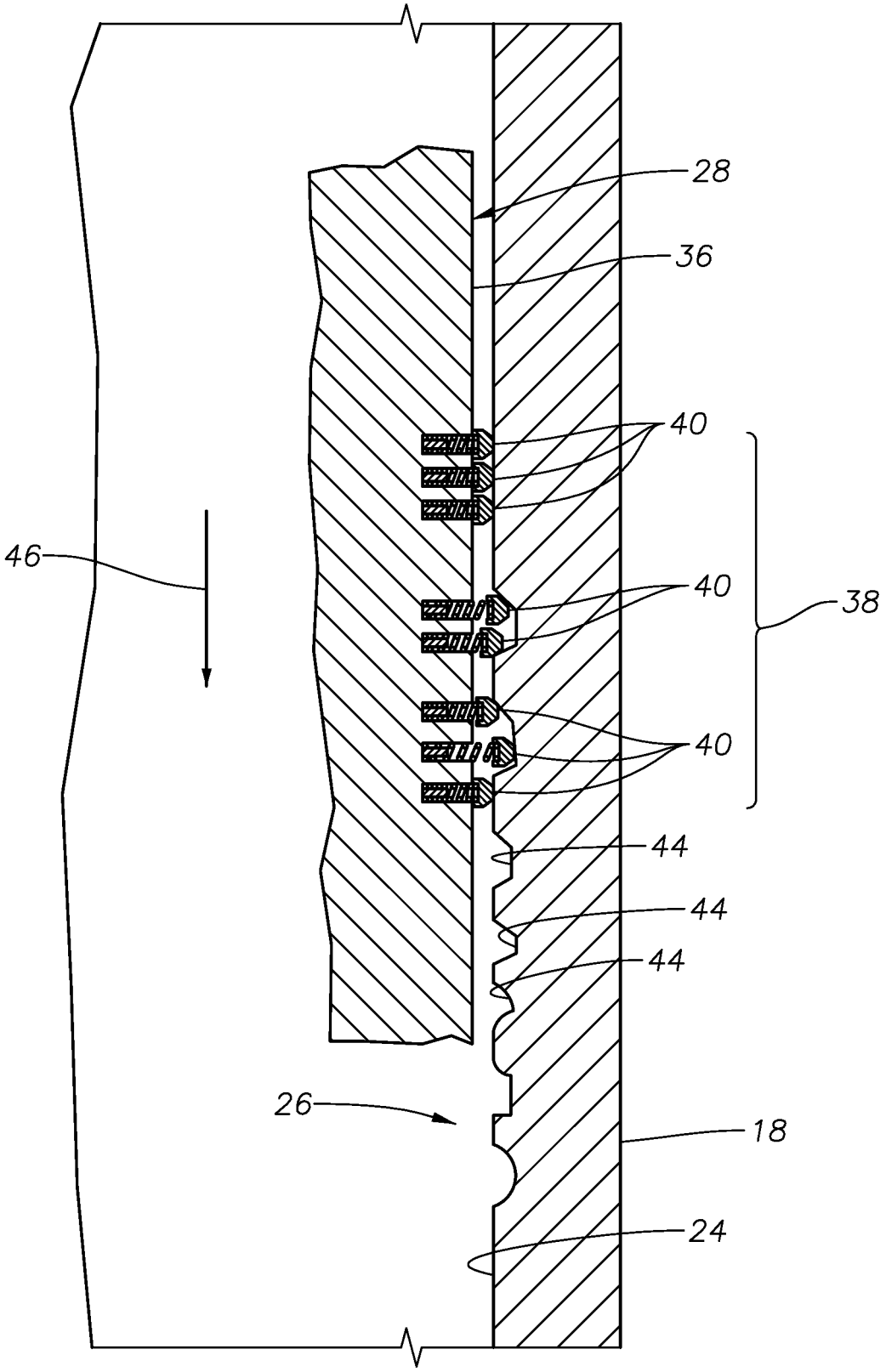
FIG. 4 is a close-up cross-sectional view illustrating contact between an exemplary actuation profile and contact profile.
Figure 10:
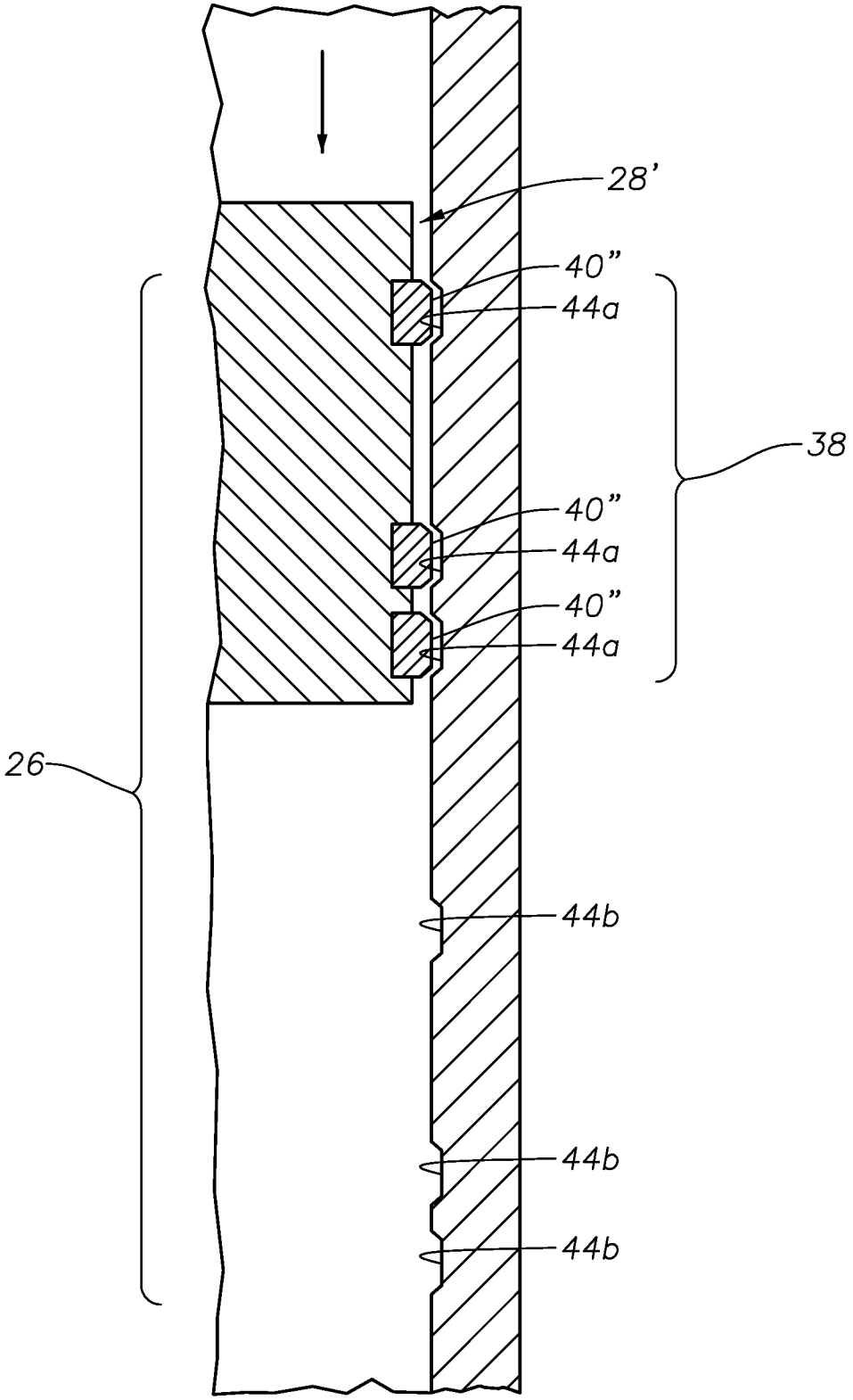
FIG. 10 is a side, cross-sectional view of an activation profile having non-spring-biased dogs encountering a contact profile.

An exemplary contact profile 26 is better seen in FIG. 4. FIG. 10 also illustrates an exemplary contact profile 26. The contact profile 26 is made up of circumferential grooves or striations 44. Grooves or striations have cross-sectional shapes which cause the dogs 40 of the activation profile 38 to create a distinctive or particular vibration along the tubular string 18. As can be seen with reference to FIG. 4, the grooves 44 may have uneven or irregular cross-sectional shapes. In FIG. 4, the signal sub 28 is shown moving downwardly within the tubular string 18 in direction of arrow 46. The activation profile 38 is beginning to encounter the contact profile 26. Vibration is being produced within the tubular string 18 as the dogs 40 impact the ridges and valleys presented by the grooves 44. FIG. 10 depicts alternative signal sub 28' having an activation profile 38 formed of non spring-biased dogs 40" encountering a contact profile 26. In certain embodiments, the dogs 40 of the activation profile 38 are all dependently tied together (i.e., the dogs 40 will simultaneously enter matching grooves 44 at once) so that they can only snap into the mating contact profile 26 when the pattern of dogs 40 matches the pattern of grooves 44 in the contact profile 26. Thus, the signal sub 28' shown in FIG. 10 will make two consecutive single impacts rather than a larger number of smaller impacts. The first impact of the vibratory signal will be created as the dogs 40" (FIG. 10) enter the upper portion of the contact profile 26 (i.e., grooves 44*a*). The second impact of the vibratory signal would be produced when the dogs 40" thereafter enter the grooves 44*b* of the lower portion of the contact profile 26. The feature of having the dogs 40 or 40" all tied together to enter complementary grooves 44 simultaneously allows the contact profile 26 pattern of grooves 44 to be designed to be keyed to a particular signal sub 28 or 28' so that other objects passing the contact profile 26 will make a distinctly different impact signal and thereby reduce the likelihood of false triggering of an associated controller and downhole device.

Figure 9:
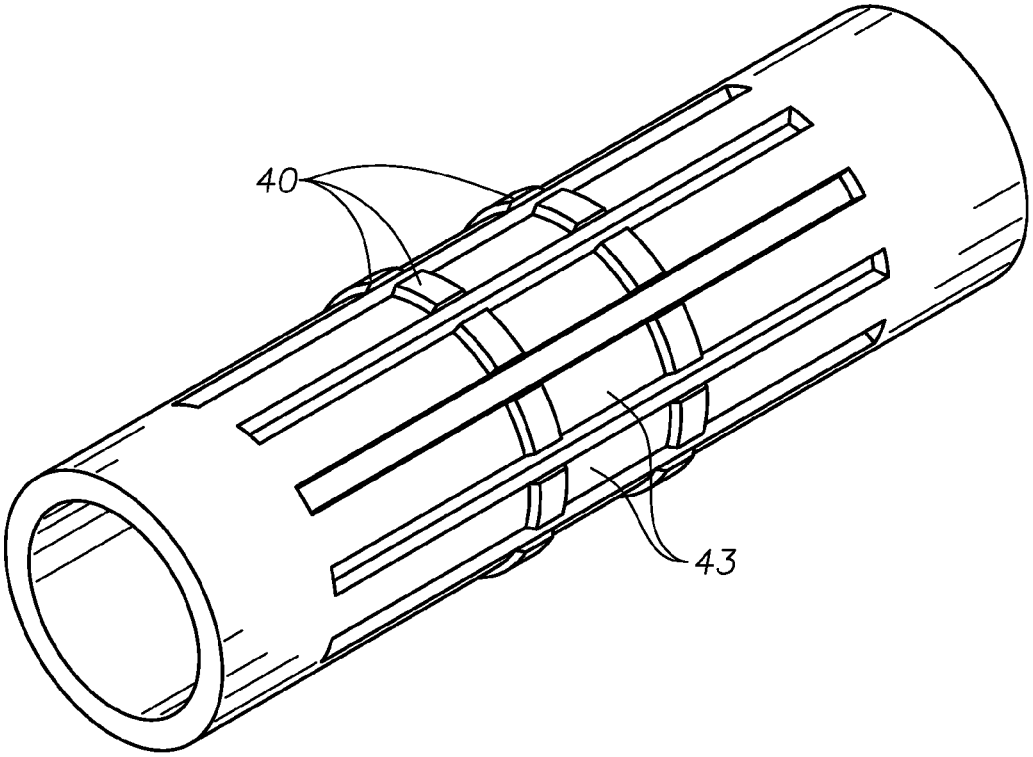
FIG. 9 is an external isometric view of an exemplary activation profile formed using collets.

According to alternative embodiments, the dogs 40 are located on machined collet-style fingers 43 (see FIG. 9) that create impacts of varying intensity with the contact profile 26. According to a further alternative embodiment, the dogs 40 are embedded into the rubber of the pump down plug's cups 32. According to still other embodiments, some or all of the dogs 40 are formed of materials having different densities, such as aluminum, steel, titanium, PEEK (polyether ether ketone), ceramics and so forth. Dogs 40 of different densities would produce impact vibrations of different amplitudes when they interact with the grooves 44 of the contact profile 26.

Figure 5:
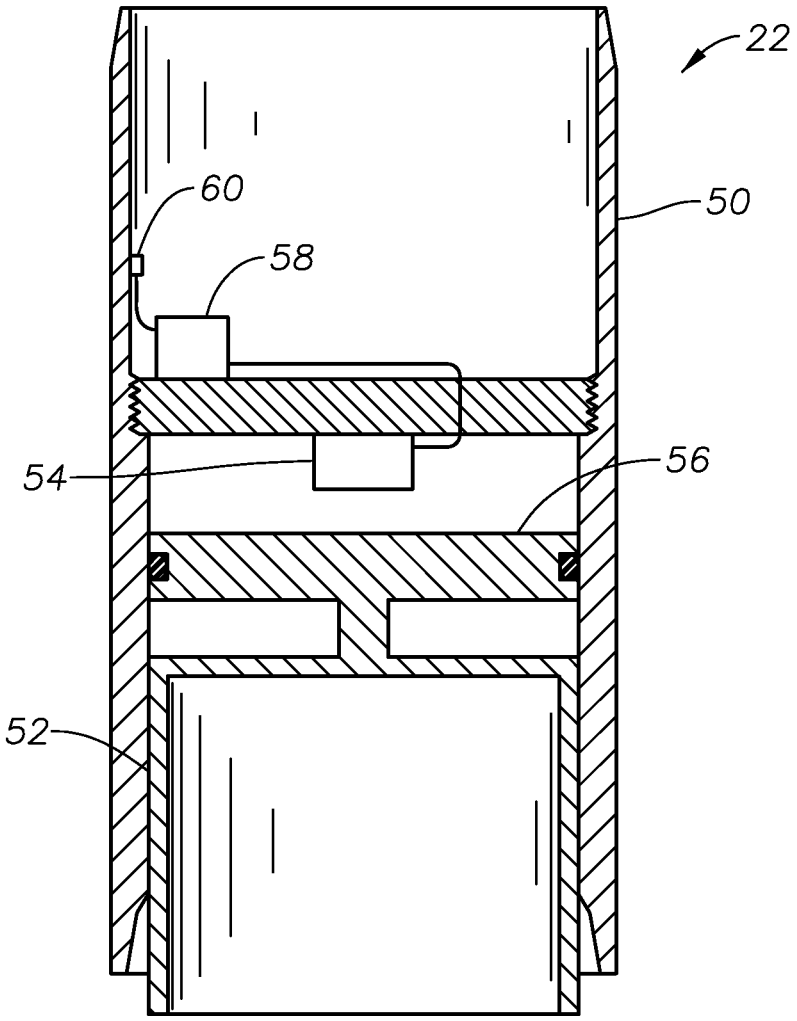
FIG. 5 is a side, cross-sectional view of an exemplary downhole device that is being activated by the signal sub.

In FIG. 1, the setting tool 22 is an electronically actuated device that will apply mechanical setting forces to the packer 20 in order to set the packer 20 either within the wellbore 10 or inside the casing 16. In one particular embodiment, the setting tool 22 is a Model E-4 packer setting device which is available commercially from Baker Hughes Incorporated of Houston, Tex. In the depicted embodiment, the packer 20 is a compression-set packer device having an elastomeric packer seal 48 that is compressed axially to be set radially outwardly against the casing 16 (see FIG. 2). FIG. 5 schematically illustrates portions of an exemplary setting tool 22 in accordance with the present invention. The setting tool 22 includes an outer housing 50 which encloses a setting sleeve 52 that is axially moved to set the packer 20. An explosive charge 54 is used to shift piston 56 and affixed setting sleeve 52 and thereby set the packer 20. A programmable controller 58 is operably associated with the explosive charge 54 to cause the charge 54 to detonate upon command from the controller 58. A sensor 60 is operably associated with the controller 58. The sensor 60 detects vibrations within the outer housing 50 and transmits signals representative of the detected vibrations to the controller 58. The controller 58 is programmed to receive such signals from the sensor 60 and to recognize the distinct vibratory signal produced by the activation profile 38 passing over the contact profile 26. In response to the sensor 60 detecting that distinct vibratory signal, the controller 58 will detonate the explosive charge 54. The controller 58 and the sensor 60 collectively make up an actuation subassembly for the downhole tool being actuated or otherwise controlled.

In operation, the present invention provides a system for actuation of one or more downhole devices. In the illustrated case, the downhole device is a packer setting tool 22. To actuate the tool 22, the plug 30 and affixed signal sub 28 are pumped down the tubular string 18, as illustrated in FIG. 1. When the signal sub 28 passes the contact profile 26 to reach the position illustrated in FIG. 2, the dogs 40 of the activation profile 38 will interact with the contact profile 26 and generate a distinctive vibratory signal within the tubular string 18. The vibratory signal is transmitted along the tubular string 18 to the housing 50 of the setting tool 22. In response, the controller 58 detonates the explosive charge 54 and sets the affixed packer 20.

Although the control system and methods of the present invention have been described herein with respect to a packer device 20 and setting tool 22, it will be understood that they may be applied for actuation or control of a wide range of downhole tools and devices. Other downhole devices which might be actuated or controlled using the systems and methods of the present invention include shifting tools, and opening tools. Also, an actuation subassembly which includes a sensor 60 and controller 58 might be provided for multiple downhole tools or devices so that a single vibratory signal produced by the activation profile 38 and contact profile 26 will actuate or otherwise control multiple devices.

Also, it should be understood that, while the signal sub 28 is shown being disposed into the tubular string 18 by means of a pump-down plug 30, it might be disposed into the tubular string 18 using other means known in the art, including coiled tubing, wireline or other running strings.

Those of skill in the art will recognize that numerous modifications and changes may be made to the exemplary designs and embodiments described herein and that the invention is limited only by the claims that follow and any equivalents thereof.

What is claimed is:

1. A system for actuating a downhole device that is operably associated with a tubular string having a tubular flowbore, the system comprising:

a contact profile within the tubular flowbore; and a signal sub that is disposed within the tubular flowbore, the signal sub presenting an activation profile that produces a vibratory signal upon contact with the contact profile; and an actuation subassembly operably associated with the downhole device, the actuation subassembly including a controller which governs actuation of the downhole device in response to the vibratory signal; and wherein the activation profile comprises at least one dog that extends radially outwardly from an outer radial surface of the signal sub.

2. The system of claim 1 further comprising a sensor operably associated with the controller, the sensor adapted to detect the vibratory signal and transmit a signal representative of the vibratory signal to the controller.

3. The system of claim 1 wherein the signal sub is disposed into the tubular flowbore connected to a pump-down plug or drop bar.

4. The system of claim 1 wherein the contact profile comprises a plurality of circumferential grooves formed within the tubular flowbore.

5. The system of claim 1 wherein the activation profile comprises a plurality of dogs that extend radially outwardly from an outer radial surface of the signal sub.

6. The system of claim 5 wherein:

the contact profile comprises a plurality of grooves that are formed to be complementary to the plurality of dogs; and the plurality of dogs are interconnected so as to enter the grooves of the contact profile simultaneously.

7. The system of claim 5 wherein the dogs are spring-biased radially outwardly.

8. The system of claim 1 wherein the downhole device is a device from the group consisting of: a packer setting tool, a shifting tool, and an opening tool.

9. A system for actuating a downhole device that is operably associated with a tubular string having a tubular flowbore, the system comprising:

a contact profile within the tubular flowbore; and a signal sub that is disposed within the tubular flowbore, the signal sub presenting an activation profile that produces a vibratory signal upon contact with the contact profile; and an actuation subassembly operably associated with the downhole device, the actuation subassembly including a controller which governs actuation of the downhole device in response to the vibratory signal and a sensor adapted to detect the vibratory signal and transmit a signal representative of the vibratory signal to the controller; and wherein the activation profile comprises at least one dog that extends radially outwardly from an outer radial surface of the signal sub.

10. The system of claim 9 wherein the contact profile comprises a plurality of circumferential grooves formed within the tubular flowbore.

11. The system of claim 9 wherein the downhole device comprises a device from the group consisting of: a packer setting tool, a shifting tool, and an opening tool.

12. The system of claim 9 wherein the dog is spring-biased radially outwardly.

13. A method of actuating or controlling a downhole device comprising the steps of:

generating a vibratory signal within a tubular flowbore;

detecting the vibratory signal;

actuating or controlling a downhole device in response to detection of the vibratory signal; and wherein the vibratory signal is generated by interaction between a contact profile within the tubular flowbore and an activation profile that is formed upon a signal sub that is disposed into the tubular flowbore, wherein the activation profile comprises a plurality of dogs that extend radially outwardly from the signal sub.

14. The method of claim 13 wherein the signal sub is disposed into the tubular flowbore via a pump-down plug, drop bar, or wireline.

15. The method of claim 13 wherein the vibratory signal is detected by a sensor.

16. A method of actuating or controlling a downhole device comprising the steps of:

producing a vibratory signal at a downhole location;

the vibratory signal then actuating a downhole device; and wherein the vibratory signal is generated by interaction between a contact profile within a tubular flowbore and an activation profile that is formed upon a signal sub that is disposed into the tubular flowbore, wherein the activation profile comprises a plurality of dogs that extend radially outwardly from the signal sub.

* * * * *